US006674417B2

(12) United States Patent
Hsu et al.

(10) Patent No.: US 6,674,417 B2
(45) Date of Patent: Jan. 6, 2004

(54) DRIVING CIRCUIT FOR A PLASMA DISPLAY PANEL WITH DISCHARGE CURRENT COMPENSATION IN A SUSTAIN PERIOD

(75) Inventors: Horng-Bin Hsu, Taipei (TW); Jih-Fon Huang, Hsin-Chu Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 149 days.

(21) Appl. No.: 09/858,515

(22) Filed: May 17, 2001

(65) Prior Publication Data

US 2001/0054994 A1 Dec. 27, 2001

(30) Foreign Application Priority Data

Jun. 23, 2000 (TW) ..... 89112373A

(51) Int. Cl.[7] ..... G09G 3/28

(52) U.S. Cl. ..... 345/60; 345/67; 345/204; 345/208; 345/211; 345/212

(58) Field of Search ..... 345/60, 67, 204, 345/208, 211, 212; 315/169.3

(56) References Cited

U.S. PATENT DOCUMENTS 4,866,349 A * 9/1989 Weber et al. ..... 315/169.4
5,654,728 A * 8/1997 Kanazawa et al. ..... 345/68
5,670,974 A * 9/1997 Ohba et al. ..... 345/60
5,943,030 A * 8/1999 Minamibayashi ..... 345/60
6,111,556 A * 8/2000 Moon ..... 345/60
6,429,834 B1 * 8/2002 Kanazawa et al. ..... 345/63
6,483,490 B1 * 11/2002 Lo ..... 345/60

* cited by examiner

*Primary Examiner*—Kent Chang
*Assistant Examiner*—Tom Sheng
(74) *Attorney, Agent, or Firm*—Winston Hsu

(57) ABSTRACT

A driving method for driving a plasma display unit of a plasma display panel. The plasma display unit includes two electrodes, and the plasma display unit is filled with ionized gas. A driving circuit drives the ionized gas back and forth between the two electrodes to cause the plasma display panel to emit light. The driving circuit includes a rating source receiver and an energy-storing current source whereby the rating source receiver is able to receive and supply a rating current. The driving method first involves the rating source receiver charging. A first electric potential difference thus occurs between the two electrodes of the plasma display unit to allow the ionized gas within the plasma display unit to discharge. While the ionized gas is discharging, the plasma display unit is supplied with a compensation current to prevent an electric potential difference drop.

17 Claims, 18 Drawing Sheets

| | $t_0$~$t_1$ | $t_1$~$t_2$ | $t_2$~$t_3$ | $t_3$~$t_4$ | $t_4$~$t_5$ | $t_5$~$t_6$ | $t_6$~$t_7$ | $t_7$~$t_8$ | $t_8$~$t_9$ |
|---|---|---|---|---|---|---|---|---|---|
| M1 | OFF | OFF | ON | ON | ON | ON | OFF | OFF | OFF |
| M2 | OFF | OFF | OFF | OFF | OFF | OFF | OFF | OFF | ON |
| M3 | OFF | OFF | ON | OFF | OFF | OFF | OFF | OFF | OFF |
| M4 | OFF | OFF | ON | ON | ON | OFF | OFF | OFF | OFF |
| M5 | OFF | OFF | OFF | OFF | OFF | OFF | OFF | OFF | OFF |
| M6 | ON | ON | ON | ON | ON | ON | ON | ON | ON |

Fig. 5

DRIVING CIRCUIT FOR A PLASMA DISPLAY PANEL WITH DISCHARGE CURRENT COMPENSATION IN A SUSTAIN PERIOD

BACKGROUND OF THE INVENTION

1. Field of the Invention

The present invention relates to a driving method for a plasma display unit. More particularly, the invention relates to a driving method that utilizes a driving circuit for current compensation to a plasma display unit in a sustain period so that the electric potential difference between the two sustain electrodes of the plasma display unit will not significantly drop due to the discharge of the ionized gas.

2. Description of the Prior Art

The plasma display panel has a large but thin size and does not produce radiation. Therefore, it is believed to be the trend of future large-sized displays. The plasma display contains a plurality of plasma display units disposed in a matrix. A predetermined constant operating voltage is provided from an external power source to drive the plurality of plasma display units in the plasma display. Different operating voltages have different affection on the performance of the plasma display. That is, some operating voltages can drive all the plasma display units well, while other operating voltages cannot correctly drive all the plasma display units to display an expected image on the plasma display panel. Thus, the plasma display must be driven by operating voltages within an allowed range. Nevertheless, even within this range, some operating voltages can provide better display over others. That is, the operating voltage of each plasma display has to be properly selected so that it is working at the optimal operating voltage. The criterion for selecting the right operating voltage is whether the voltage makes all of the plasma display units function normally. The proper operating voltage is usually selected and fine-tuned by test technicians of the manufacturer.

Please refer to FIG. 1. FIG. 1 shows the equivalent circuit of a prior art plasma display. The plasma display 100 can be equivalently considered as a capacitor-like load. The driving principle is to provide a current $I_{PDP}$ to charge/discharge this capacitor-like load so as to produce high-voltage and high-frequency alternating voltage square wave $V_{PDP}$ on both ends of the capacitor-like load of the plasma display panel 100. The charges of the plasma in the plasma display units are therefore driven back and forth and radiate ultraviolet light to excite the fluorescent material applied on the partition wall. When the plasma display is in the sustain period, imposing both ends of the capacitor-like load to high-voltage and high-frequency alternating square wave voltage causes ionized gas to discharge and instantaneously produce an extremely large gas discharge current $I_E$. This discharge current $I_E$ causes a great voltage drop. The great voltage drop of electric potential difference between the two electrodes of the display unit is also called the voltage notch phenomenon. Usually, the stronger the intensity of the plasma display is, the larger the gas discharge current and the deeper the voltage notch are.

Please refer to FIG. 2. FIG. 2 shows the waveform shape of the voltage notch in a prior art plasma display. In FIG. 2, the prior art driving circuit of the plasma display of the prior art has a voltage notch (labeled 110 in FIG. 2) of about 16.4V(Volts) with a operating voltage 170V. The plasma display contains many plasma display units, and it is very difficult to make all of them identical. Therefore the proper operating range of the operating voltage and the time when the discharge current occurs for each individual plasma display unit are slightly different. Some plasma display units discharge right at the time when voltage notches occur, then the discharge intensity of these plasma display units are degraded. Under the circumstance of extremely serious voltage notch, the plasma display unit will be unable to sustain discharging and make the whole plasma display fail to function properly. Also the operating range of operating voltage for the plasma display becomes narrower. Although plasma displays are already adjusted to their optimized operating voltages when they are produced, the operating range of the operating voltage will change due to the aging of the plasma display unit. Once the operating voltage range of the plasma display unit shifts out of the predetermined voltage set by the manufacturer, the plasma display will not be able to display correctly and has to be adjust again. To prevent such situations, it is desirable to increase the operating voltage range of the plasma displays; decreasing or even eliminating the voltage notch phenomenon is certainly an effective way to achieve such goal.

SUMMARY OF THE INVENTION

Accordingly, it is a primary object of the present invention to provide a novel driving method for a plasma display unit, which can effectively drive a plasma display unit by making current compensation so as to provide sufficient current for the plasma display to discharge. Therefore, the invention can reduce or even eliminate the voltage notch phenomenon of the driving waveforms to solve the problem in the prior art.

In a preferred embodiment, the present invention provides a driving method for driving a plasma display unit of a plasma display panel. The plasma display unit includes two electrodes, and the plasma display unit is filled with ionized gas, whereby a driving circuit drives the ionized gas back and forth between the two electrodes to cause the plasma display panel to emit light. The driving circuit includes a rating source receiver and an energy storing current source, the rating source receiver receives and supplies a rating current. The driving method involves first charging the energy storing current source with the rating source receiver to cause the energy storing current source to generate a compensation current, which is larger than the rating current. A first electric potential difference is generated between the two electrodes of the plasma display unit to cause the ionized gas within the plasma display unit to discharge. While the ionized gas is discharging, the plasma display unit is provided with the compensation current generated by the energy storing current source to prevent an electric potential difference drop caused by the insufficient supply of the rating current for the discharging of the ionized gas.

It is an advantage of the present invention that an energy storing current source is used to generate a compensation current. The compensation current is provided to the plasma display unit to reduce the voltage notch phenomenon in the plasma display driving waveforms and to ensure display quality even after prolonged use.

These and other objectives of the present invention will no doubt become obvious to those of ordinary skill in the art after reading the following detailed description of the preferred embodiment, which is illustrated in the various figures and drawings.

BRIEF DESCRIPTION OF THE DRAWINGS

FIG. 5 is a switching time diagram of the switches M1 through M6 in the double-sided driving unit in FIG. 4.

DETAILED DESCRIPTION OF THE INVENTION

Figure 1:
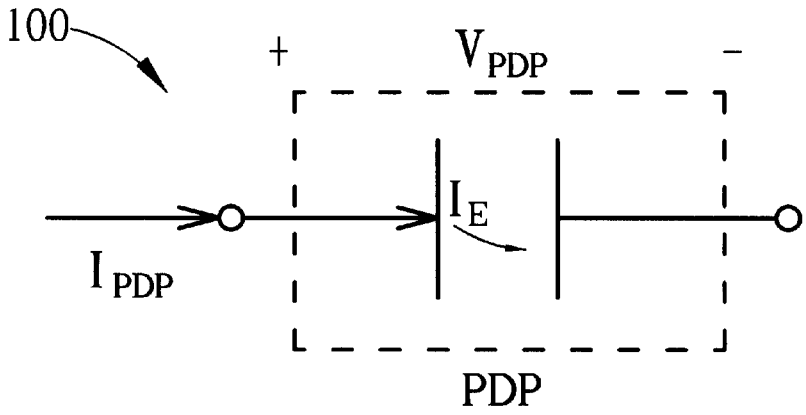
Fig. 1 Prior art
FIG. 1 is an equivalent circuit of a prior art plasma display.
Figure 2:
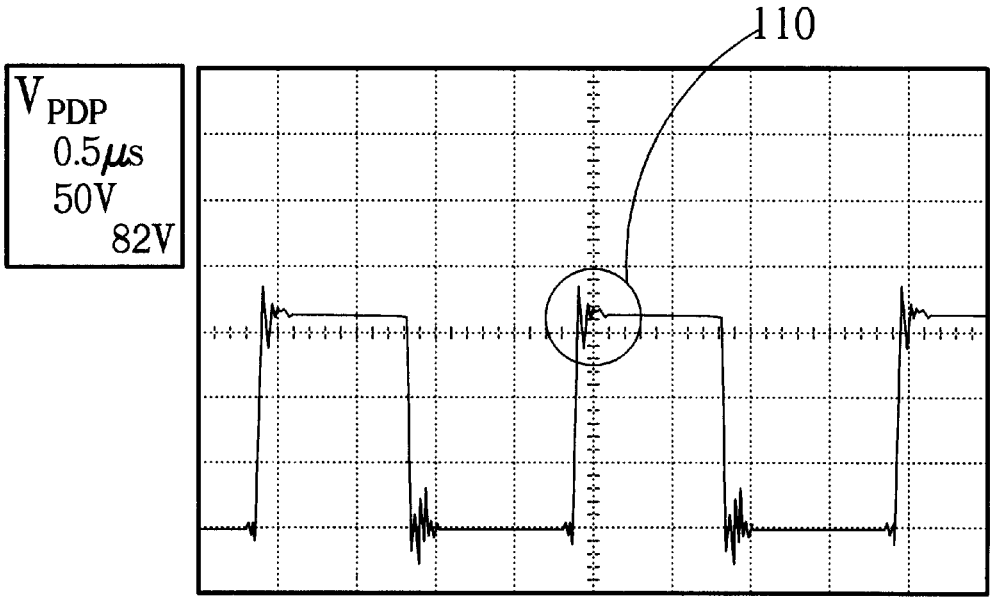
Fig. 2 Prior art
FIG. 2 illustrates the waveforms of the voltage notch phenomenon occurring in the prior art plasma display.
Figure 3:
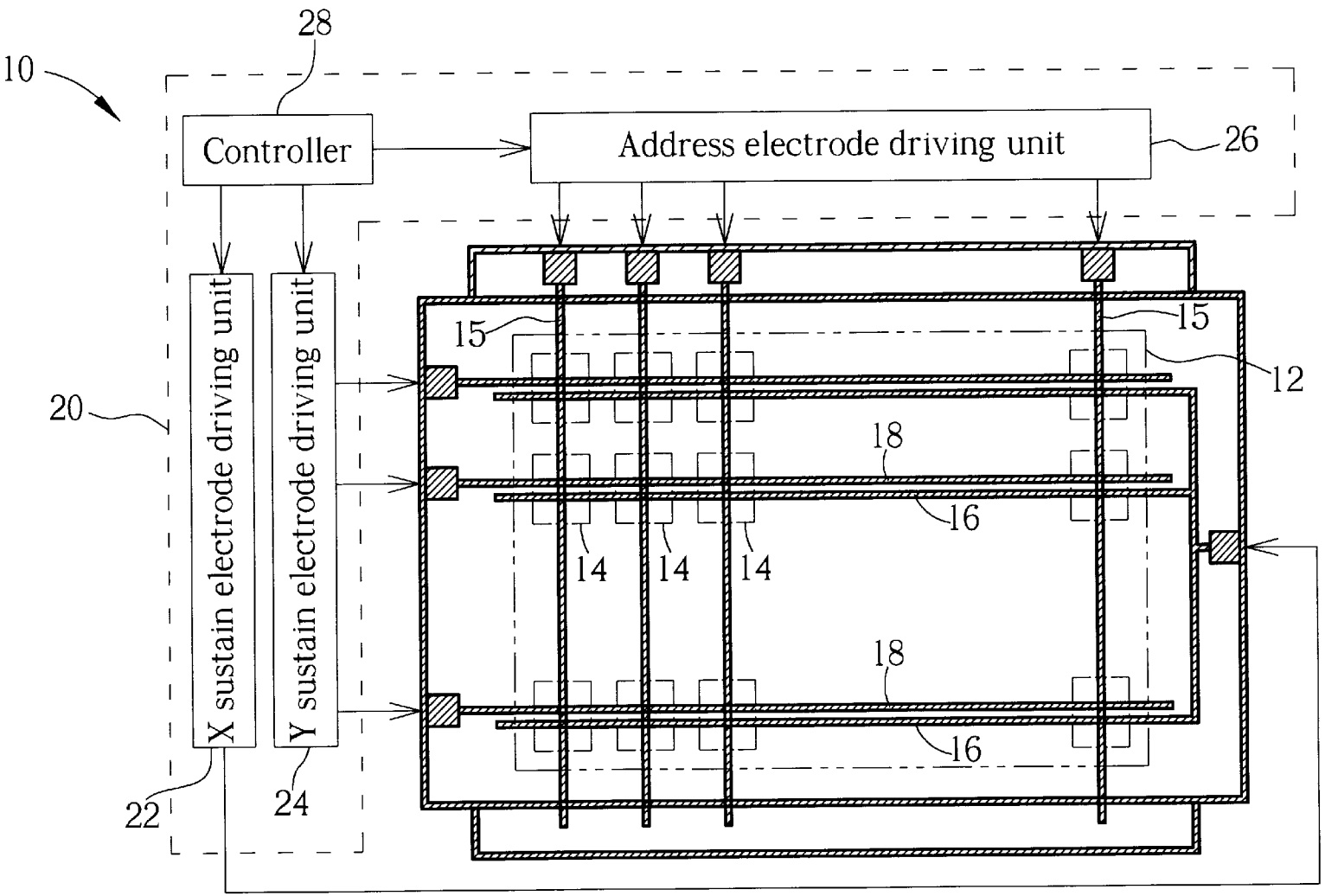
FIG. 3 shows a schematic structure of the plasma display system according to the present invention.

Please refer to FIG. 3. FIG. 3 illustrates the structure of the plasma display system 10 of the present invention. The plasma display system 10 has a plasma display panel 12 to display images and a driving circuit 20 to drive and control the display status of the image on the plasma display panel 12. The plasma display panel 12 contains a plurality of plasma display units 14, each plasma display unit 14 is filled with ionized gas. The system 10 further contains a set of address electrodes 15 and two sets of sustain electrodes 16 and 18. The driving circuit 20 includes an X sustain electrode driving unit 22, a Y sustain electrode driving unit 24, an address electrode driving unit 26 and a controller 28. The X and Y sustain electrode driving units 22, 24 drive the X and Y sustain electrodes 16, 18, respectively, so that the ionized gas within the plasma display unit 14 is driven back and forth between the X and Y sustain electrodes 16, 18 to cause the plasma display unit 14 to emit light.

In other words, an embodiment of the driving circuit 20 has: (a) a rating current receiver capable of receiving electrical power from a rating voltage source 32 (Vdc) and providing a rating current; (b) a first driving unit 22 electrically connected to the rating voltage source 32 and the X electrode of the plasma display unit 14; and (c) a controller 28 (in FIG. 3) electrically connected to the first driving unit 22 and the receiving terminal of the rating voltage source 32. The first driving unit 22 has an energy storing current source $L_1$, which can provide a compensation current $I_{L1}$. The energy storing current source $L_1$ generates a first electric potential difference between the X and Y electrodes of the plasma display unit 14 to cause the ionized gas within the plasma display unit 14 to discharge between the two sustain electrodes X and Y. The controller 28 can selectively cause the rating voltage source 32 to charge the energy storing current source $L_1$ so that the energy storing current source generates the compensation current $I_{L1}$. Therefore, when the ionized gas in the plasma display unit 14 discharges, the compensation current $I_{L1}$ can be used to stabilize the electric potential difference between the X and Y electrodes of the display unit 14.

A driving method according to the present embodiment contains the following steps: (a) charging the energy storing current source $L_1$ with the rating voltage source 32 receiving terminal 60 to cause the energy storing current source generator $L_1$ to generate the compensation current $I_{L1}$, wherein the compensation current $I_{L1}$ is larger than the rating current provided by the rating voltage source; (b) using the energy storing current source generator $L_1$ to generate an electric potential difference between the X and Y electrodes of the plasma display unit 14 so that the ionized gas within the plasma display unit 14 begins to discharge; and (c) while the ionized gas of the plasma display unit 14 is discharging, using the energy storing current source $L_1$ to supply the plasma display unit 14 with the compensation current $I_{L1}$ so as to prevent a drop in electric potential difference caused by the insufficient rating current. Since the compensation current is larger than the rating current supplied by the rating voltage source 32 (Vdc) the drop in electric potential between the X-Y electrodes caused by the insufficient rating current will not happen when the ionized gas discharge.

Figure 4:
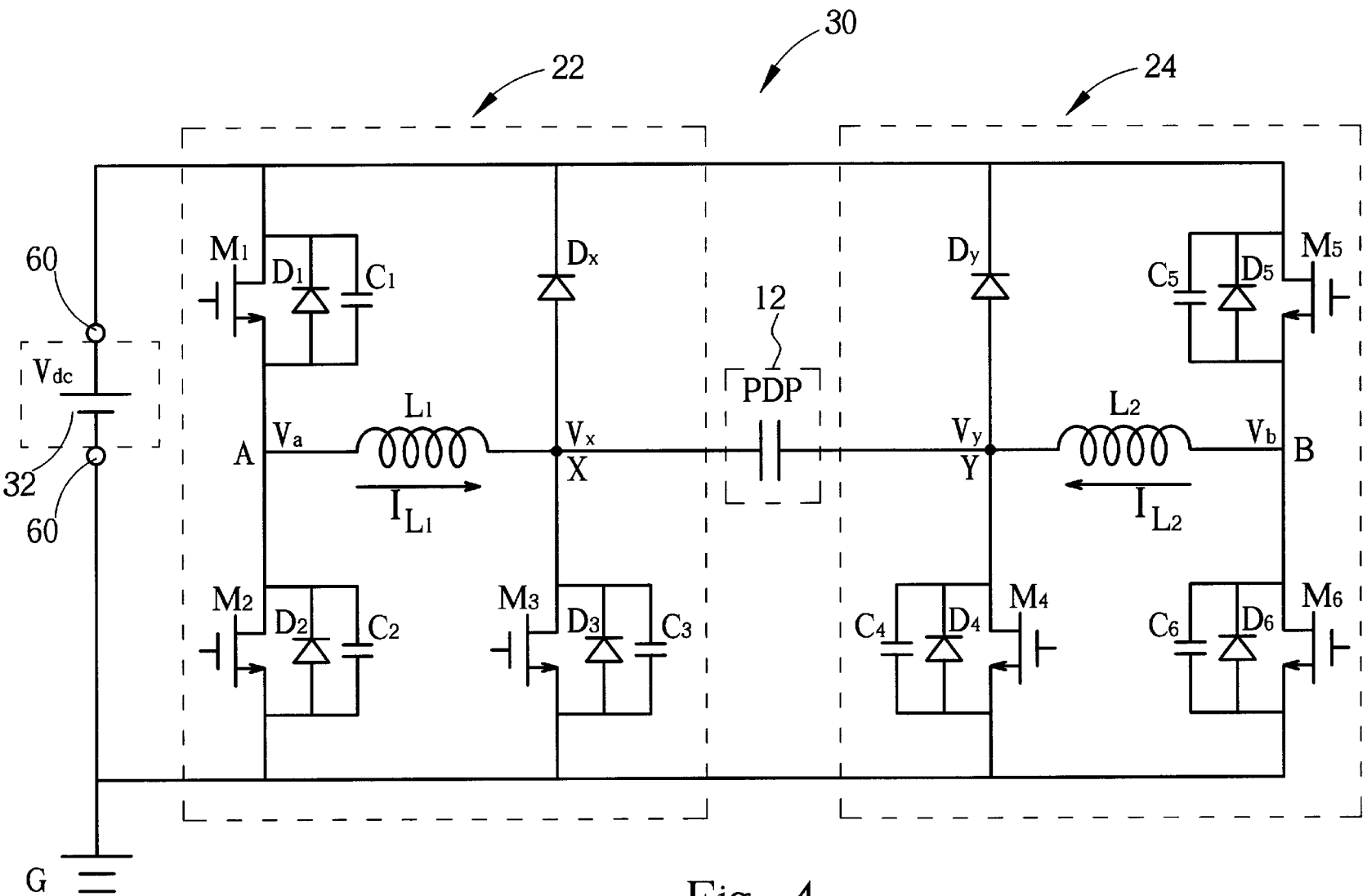
FIG. 4 shows the circuit of the double-sided driving unit of the plasma display unit according to a first embodiment of the present invention.

Please refer to FIG. 4. FIG. 4 demonstrates the first embodiment of the double-sided driving unit according to the present invention. Because a plasma display panel 12 can be regards as a capacitor-like load (denoted by PDP), and the X and Y sustain electrode driving units 22, 24 respectively connect to both ends of this capacitor-like load to sustain the display of an image signal by charging the capacitor-like load back and forth, the X and Y sustain electrode driving units 22, 24 are symmetrical. Each sustain electrode driving unit can be considered a single-sided driving unit, and the combination of the two single-sided driving unit is called a double-sided driving unit 30. Furthermore, the double-sided driving unit 30 also contains a rating voltage source 32 to provide both an operating voltage Vdc and a rating current to the single-sided driving units 22, 24; and a control circuit (not shown) to control switches M1 through M6 in the single-sided driving units 22, 24 so that the rating voltage source 32 is able to charge the plasma display panel 12 back and forth through the single-sided driving units 22, 24.

The single-sided driving unit 22 contains an inductor L1 with two ends A, X; a switch M1 electrically connected to the voltage source 32 and the end A of the inductor L1; a switch M2 electrically connected to both the end A of the inductor L1 and the ground G; a switch M3 electrically connected to the end X of the inductor L1 and the ground G; and a diode Dx electrically connected between the voltage source 32 and the end X of the inductor L1. The negative polarity end of the diode Dx electrically connects to the voltage source 32. The voltages on the two ends A, X of the inductor L1 are denoted by Va, Vx, respectively, and the end X is connected to the first end of the plasma display panel 12. The single-sided driving unit 24 contains an inductor L2 with two ends B, Y; a switch M5 electrically connected to the voltage source 32 and the end B of the inductor L2; a switch M6 electrically connected to the end B of the inductor L2 and the ground G; a switch M4 electrically connected to the end Y of the inductor L2 and the ground G; and a diode Dy electrically connected between the voltage source 32 and the end Y of the inductor L2. The negative polarity end of the diode Dy is electrically connected to the voltage source 32. The voltages on the two ends B, Y of the inductor L2 are denoted by Vb, Vy, respectively, and the end Y is connected to the second end of the plasma display panel 12. In FIG. 4, the six switches M1 through M6 are power metal-oxide semiconductor field effect transistors (MOSFETs). There are a parasite diode and a parasite capacitor between the source and drain of each transistor; the parasite diodes of the six transistors are denoted by D1, D2, D3, D4, D5, and D6; and the parasite capacitors are denoted by C1, C2, C3, C4, C5, and C6, respectively, in FIG. 4.

Please refer to FIG. 5. FIG. 5 is time diagram of the switches M1 to M6 of the double-sided driving unit 30 in FIG. 5. The controller 28 of the double-sided driving unit 30 controls on or off of switches M1 to M6. In FIG. 5, an ON means that the corresponding switch is turned on (and therefore forms an electrical connection between the two ends of the switch), and an OFF means that the corresponding switch is turned off (and forms an electrical disconnection in the circuit).

Figure 6:
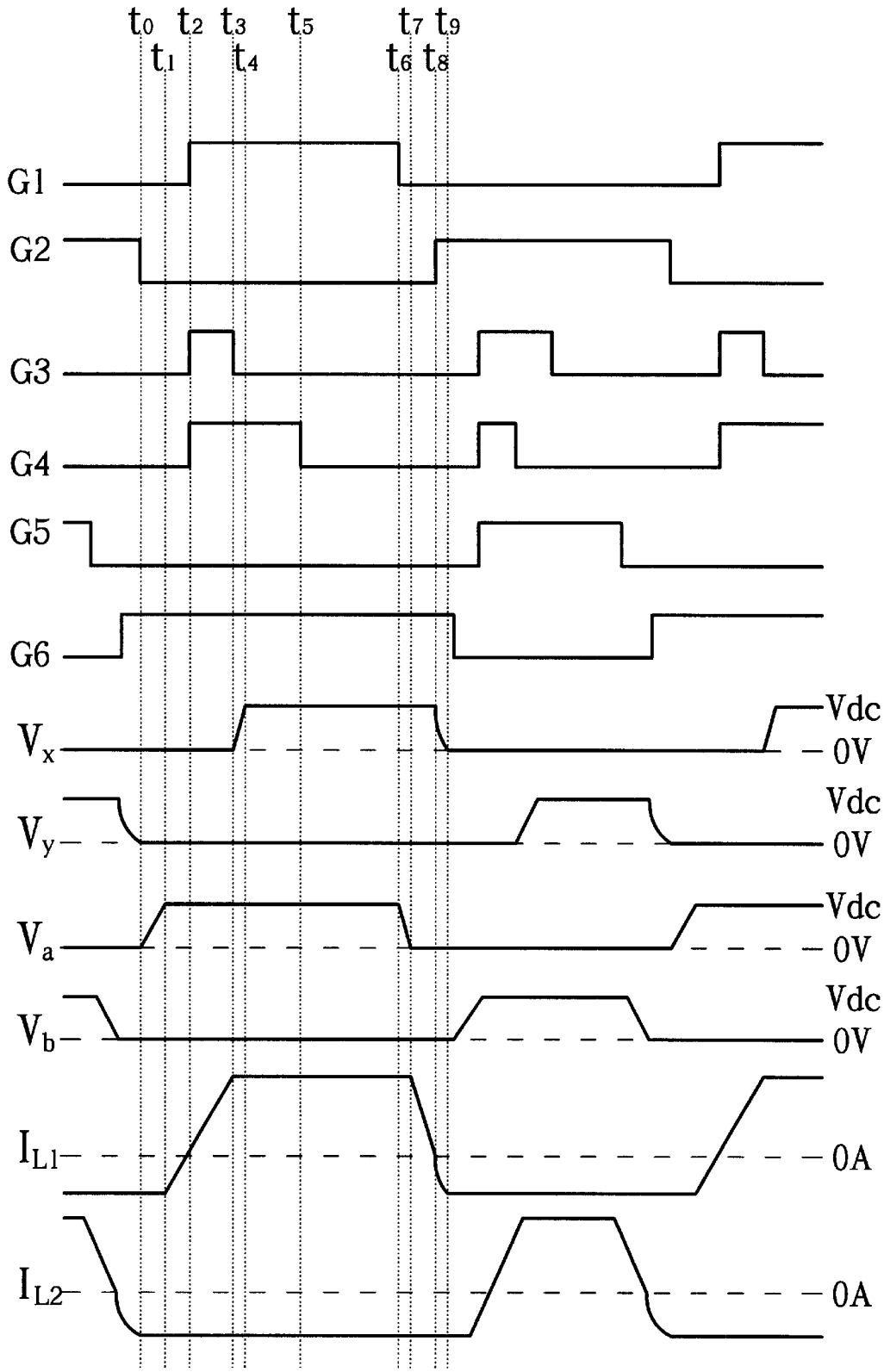
FIG. 6 is a time diagram of the double-sided driving unit in FIG. 4.

Please refer to FIG. 6. FIG. 6 demonstrates the time diagram of the double-sided driving unit 30 in FIG. 4. Waveforms of signals G1, G2, G3, G4, G5, and G6 refer to the input signals at the gates of the switches M1, M2, M3, M4, MS, and M6, respectively. The signals G1, G2, G3, G4, G5, and G6 are all controlled by the control circuit 28 of the double-sided driving unit 20. Current $I_{L1}$ is the current through the inductor L1, and current $I_{L2}$ is the current through the inductor L2. Notations Va and Vx are respectively the electric potentials on two ends of the inductor L1; Vb and Vy are respectively the electric potentials on two ends of the inductor L2. Note that Vx and Vy are also the electric potentials on the first and second ends of the plasma display panel 12, respectively.

Please refer to FIGS. 7 through 17. FIGS. 7 through 17 illustrate how the double-sided driving unit 30 in FIG. 4 works at different time points. The detailed control procedure of the double-sided driving unit 20 is described as follows.

Figure 7:
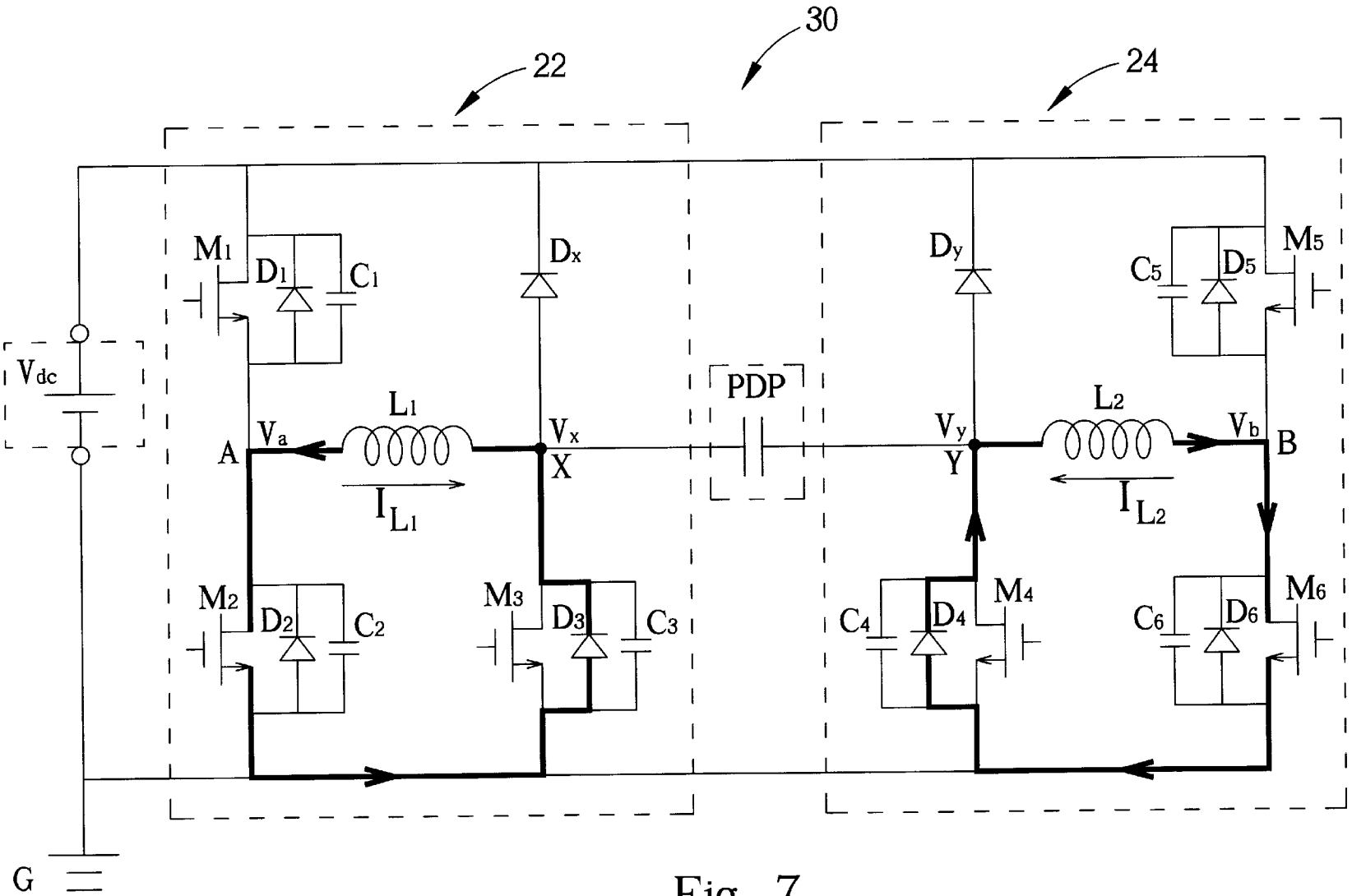
FIGS. 7 through 17 illustrate how the double-sided driving unit in FIG. 4 work at different time points.

(1) The operating way of the driving unit in the first stage is shown in FIG. 7. Before the time point $t_0$, the switches M1, M3, M4 and M5 are turned off (and therefore electrically open), the switches M2 and M6 are turned on, and electric potential Va, Vb, Vx, and Vy are all at 0V. At this stage, the electric potential difference between the ends A and X of the inductor L1 is 0 so that the current $I_{L1}$ flows through switch M2 and the parasite diode D3 of the switch M3 to form a constant current loop. Similarly, the electric potentials on the ends B and Y of the inductor L2 are 0. Therefore, the current $I_{L2}$ flows through the switch M6 and the parasite diode D4 of switch M4 to form another constant current loop.

Figure 8:
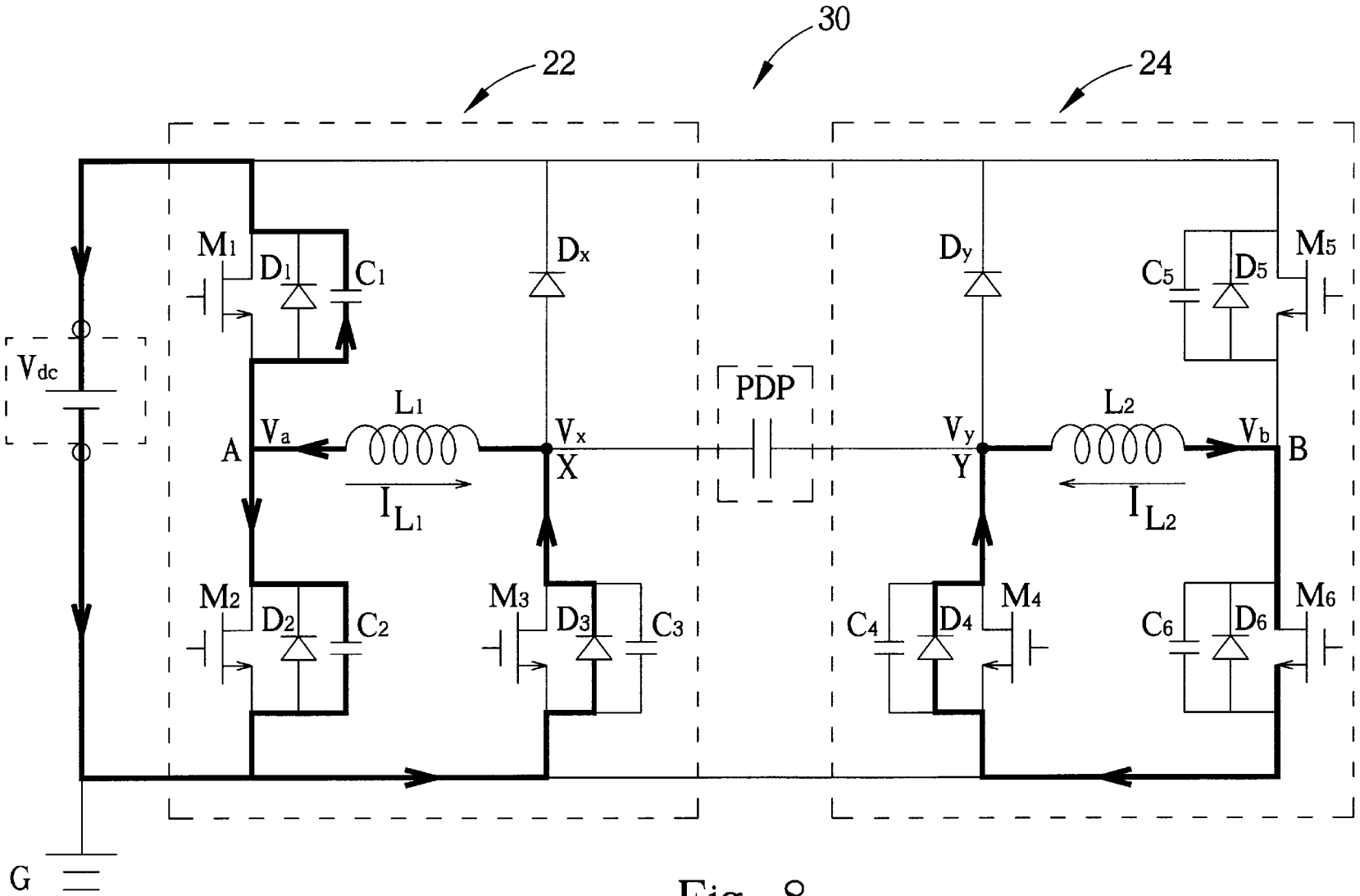

(2) As shown in FIG. 8 for the second stage at the time point $t_0$, the switch M2 is turned off. Because of the continuity of the inductance current, the current $I_{L1}$ of the inductor L1 begins to discharge the parasite capacitor C1 of the switch M1 and to charge the parasite capacitor C2 of the switch M2, therefore the voltage Va of the end A starts to rise. The current $I_{L2}$ of the inductor L2 remains in the same situation as in the first stage.

Figure 9:
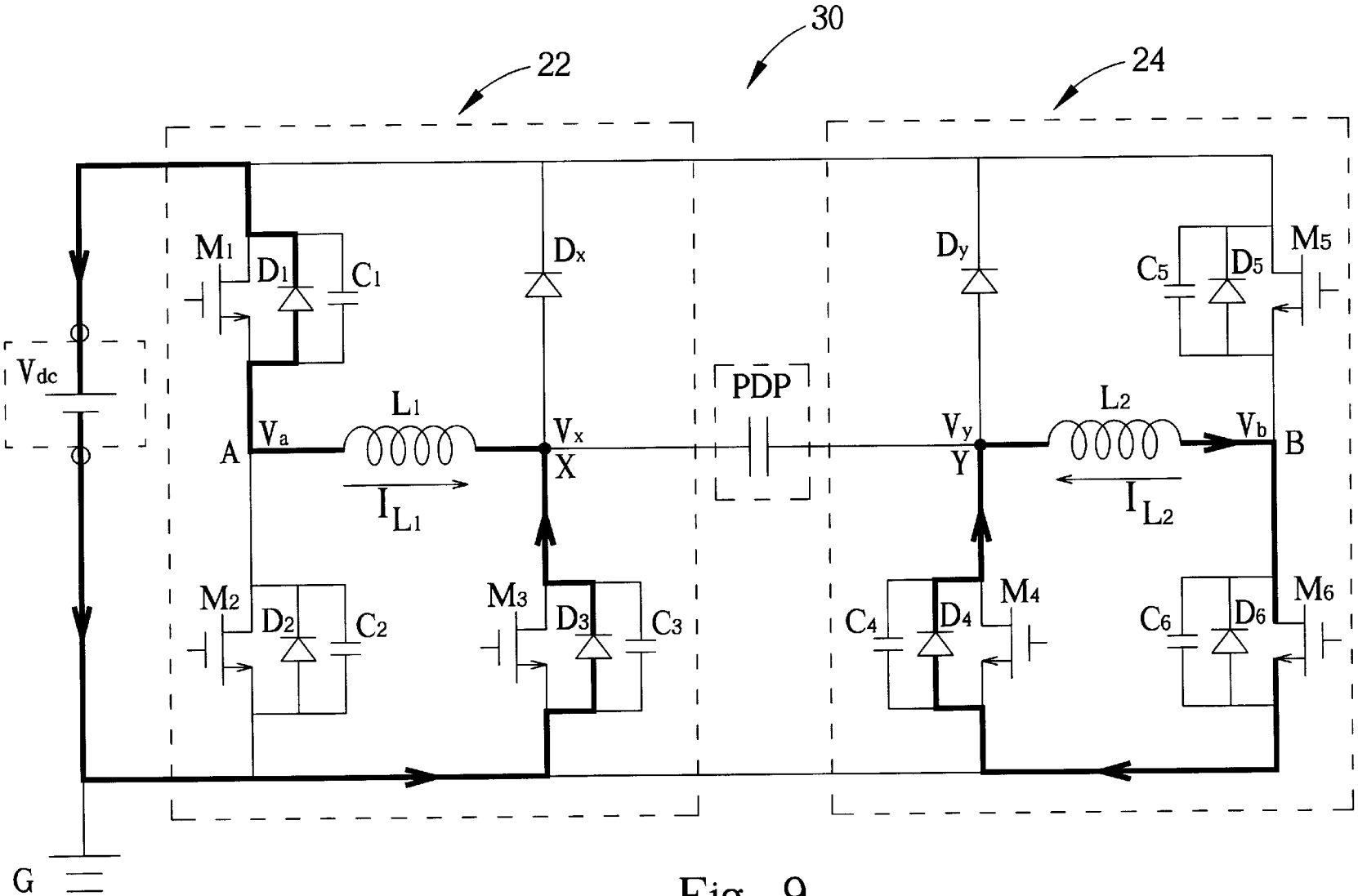

(3) As shown in FIG. 9 for the third stage at time point $t_1$, the voltage Va of the end A rises to Vdc. So the parasite diode D1 of the switch M1 begins to turn on. Also the current $I_{L1}$ of the inductor L1 flows through the parasite diode D3 of the switch M3 to the parasite diode D1 of the switch M1, and back to the voltage source 32. The energy stored in the inductor L1 is then sent back to the voltage source 32, achieving the required energy feedback function of the driving circuit in the sustain period. For the Y sustain electrode driving unit 24, the current $I_{L2}$ of the inductor L2 remains the same as in the first stage.

Figure 10:
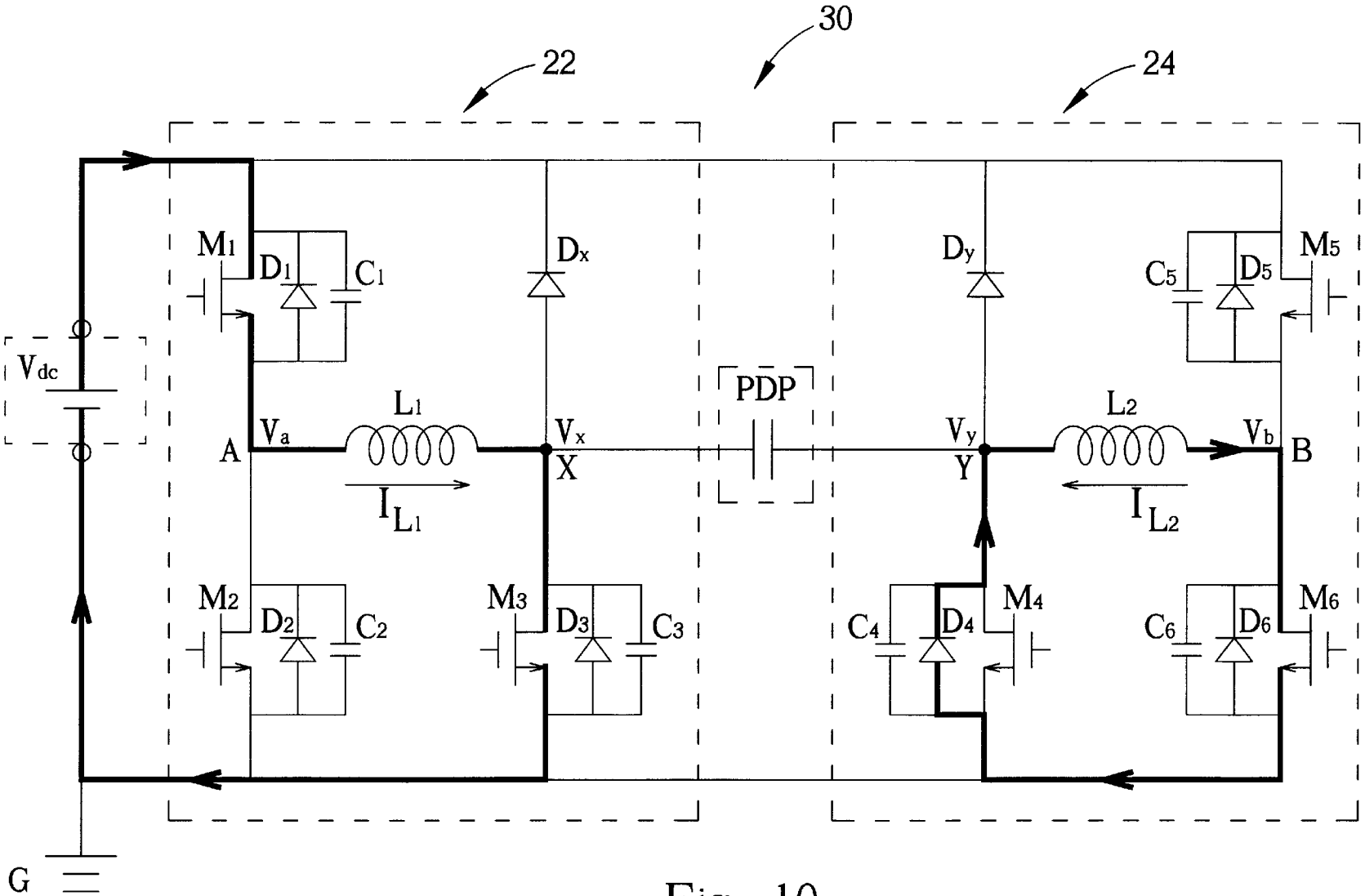

(4) As shown in FIG. 10 for the fourth stage at time $t_2$, the current $I_{L1}$ of the inductor L1 decreases to 0 and the switches M1, M3 and M4 are turned on (the current flows through the parasite diode D4 of M4 because the switch M4 is reverse biased). At time point $t_2$, the voltage Va at end A is Vdc and the voltages Vx and Vy at ends X and Y are both 0V, thus the switches M1, M3 and M4 switch at zero voltage. At this stage, the voltage source 32 charges the inductor L1 through the switches M1 and M3. The voltage difference between ends A and X of the inductor L1 is equal to the voltage Vdc of the voltage source 32. Accordingly, the current $I_{L1}$ of the inductor L1 will increase at a time rate of Vdc/L1. This current $I_{L1}$ is the current source used in later stages to generate the compensation current for compensating the discharge current of the plasma display. The magnitude of the current $I_{L1}$ is determined by the amount of the discharge current of the plasma display panel 12 to be compensated. The current $I_{L1}$ can be modified by changing the inductance of the inductor L1 or the charging time interval between time points $t_2$ and $t_3$. In a plasma display product, the inductance of the inductor L1 is fixed; therefore, one can use a control program to determine the charging time interval according to the average brightness of the plasma display panel to obtain the optimized current with most efficiency. The current $I_{L2}$ flowing through the inductor L2 is the same as the first stage. As to the Y sustain electrode driving unit 24, the current $I_{L2}$ flowing through the inductor L2 is the same as the first stage. The conduction of the switch M4 is for directly guiding the charging/discharging current of the plasma display panel 12 to the ground G in the next two stages but has no effect in the current stage.

Figure 11:
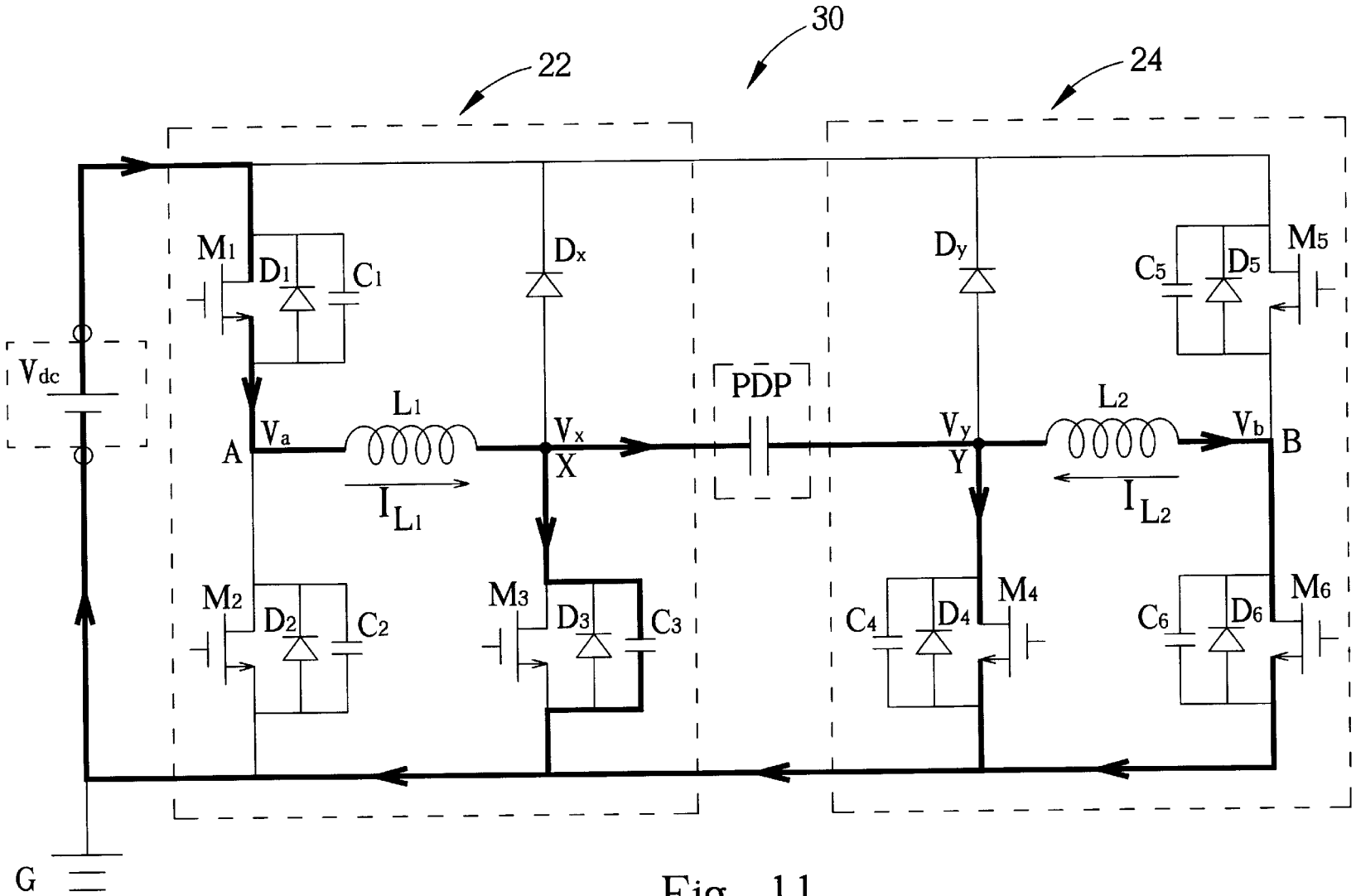

(5) As shown in FIG. 11 for the fifth stage, at time point $t_3$, the switch M3 is turned off and the current $I_{L1}$ of the inductor L1 begins to charge the plasma display panel 12 and the parasite capacitor C3 of the switch M3. Then the voltage Vx at end X starts to rise. Since the charging current of the plasma display panel is greater than the current $I_{L2}$ through the inductor L2 at this time point and the voltage difference between ends B and Y of the inductor L2 is 0 to make the current $I_{L2}$ of the inductor L2 remain unchanged. Therefore, part of the charging current of the plasma display panel flows back to the ground G through both the inductor L2 and the switch M6, while the remaining current flows through the switch M4 to the ground G.

Figure 12:
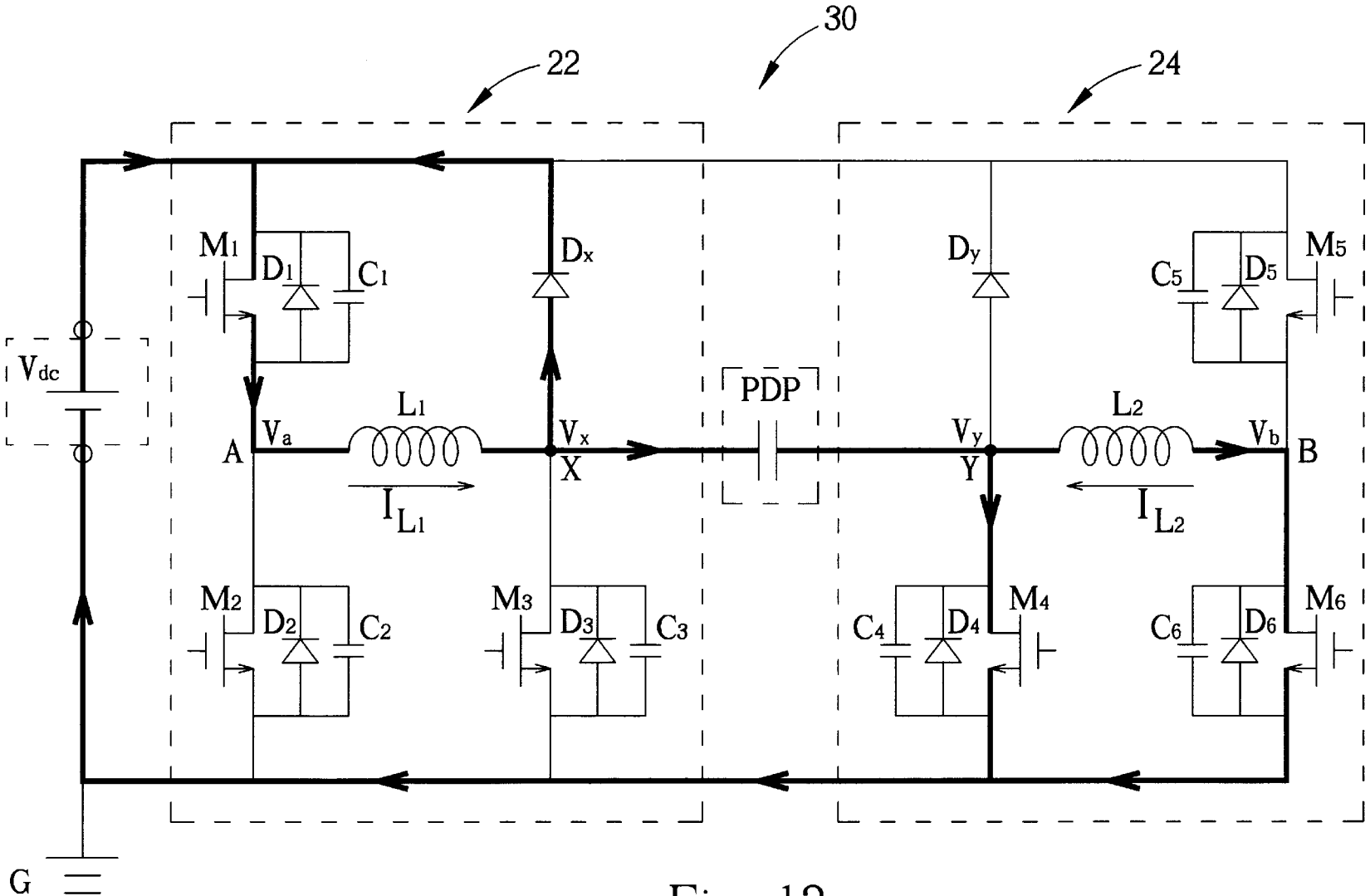

(6) As shown in FIG. 12 for the sixth stage at time $t_4$, the voltage Vx at end X rises to Vdc and the diode Dx begins to turn on. Part of the current $I_{L1}$ of the inductor L1 provides the discharge current of the plasma display panel required for discharging the ionized gas, while the rest current flows through the diode Dx. As the current $I_{L1}$ of the inductor L1 provides sufficient discharge current for the plasma display panel to discharge the ionized gas, the voltage Vx is clamped at the voltage Vdc of the voltage source 32. As a result, the voltage notch phenomenon due to the insufficient discharge current in the plasma display panel can be eliminated. In the Y sustain electrode driving unit 24, when the gas discharge current of the plasma display panel is larger than the current $I_{L2}$ of the inductor L2, additional current flows through the switch M4 back to the ground G because the current is kept fixed. If the gas discharge current of the plasma display panel is less than the current $I_{L2}$ of the inductor L2, the insufficient amount of current flows through the parasite diode D4 of the switch M4 to form a current loop.

Figure 13:
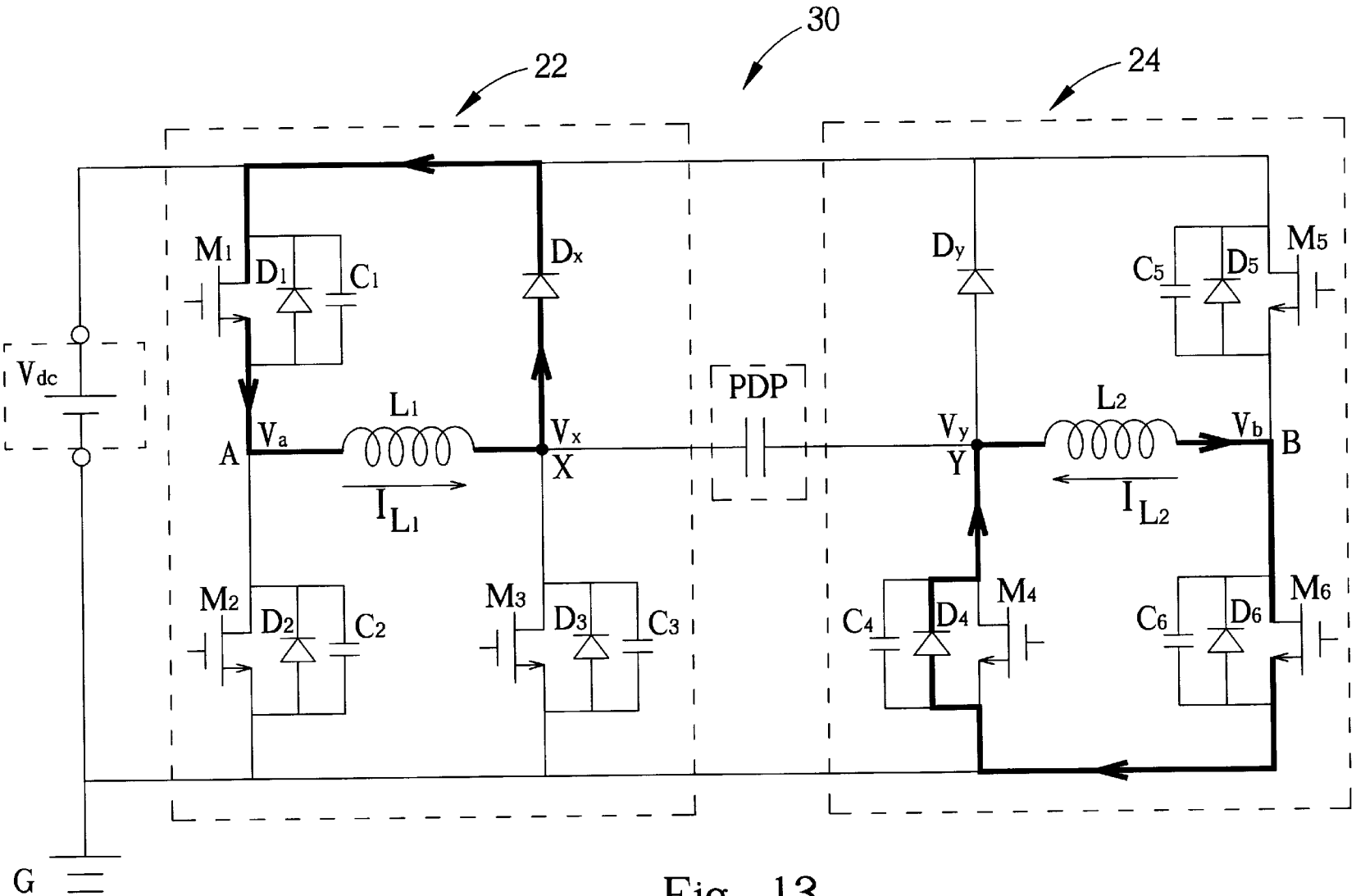

(7) As shown in FIG. 13 for the seventh stage, when gas discharge in the plasma display panel is completed (at time $t_5$ labeled in FIG. 6), then the switch M4 is turned off. The current $I_{L1}$ of the inductor L1 flows through both the switch M1 and the diode Dx to form a constant current loop. The current $I_{L2}$ of the inductor L2 flows through both the switch M6 and the parasite diode D4 of the switch M4 to form another constant current loop.

Figure 14:
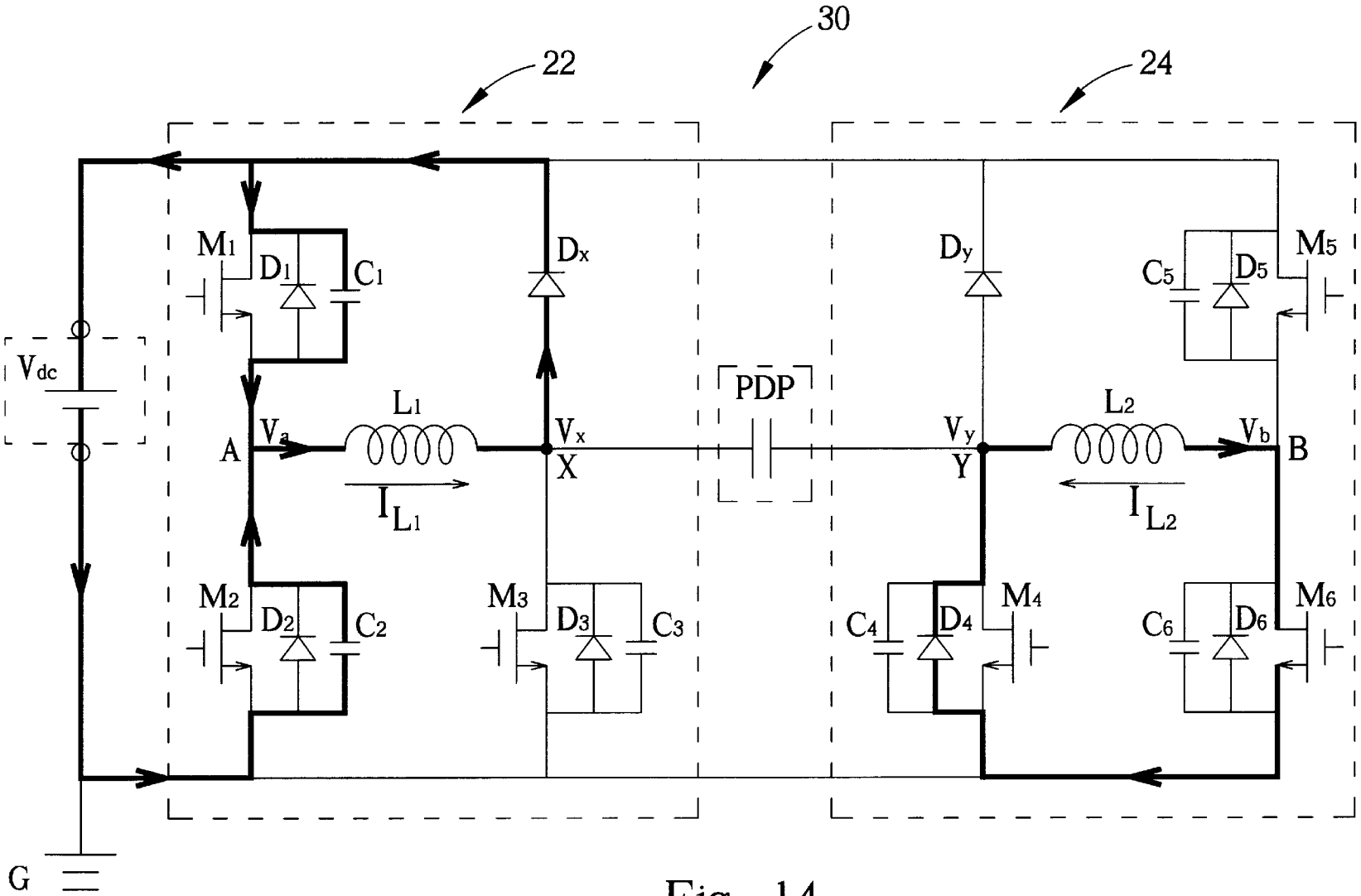

(8) As shown in FIG. 14 for the eighth stage at time $t_6$, the switch M1 is turned off and the current $I_{L1}$ of the inductor L1 simultaneously charges the parasite capacitor C1 of the switch M1 and discharges the parasite capacitor C2 of the switch M2. Therefore, the voltage Va at end A begins to drop. In the Y sustain electrode driving unit 24, the current $I_{L2}$ of the inductor L2 is the same as in the first stage.

Figure 15:
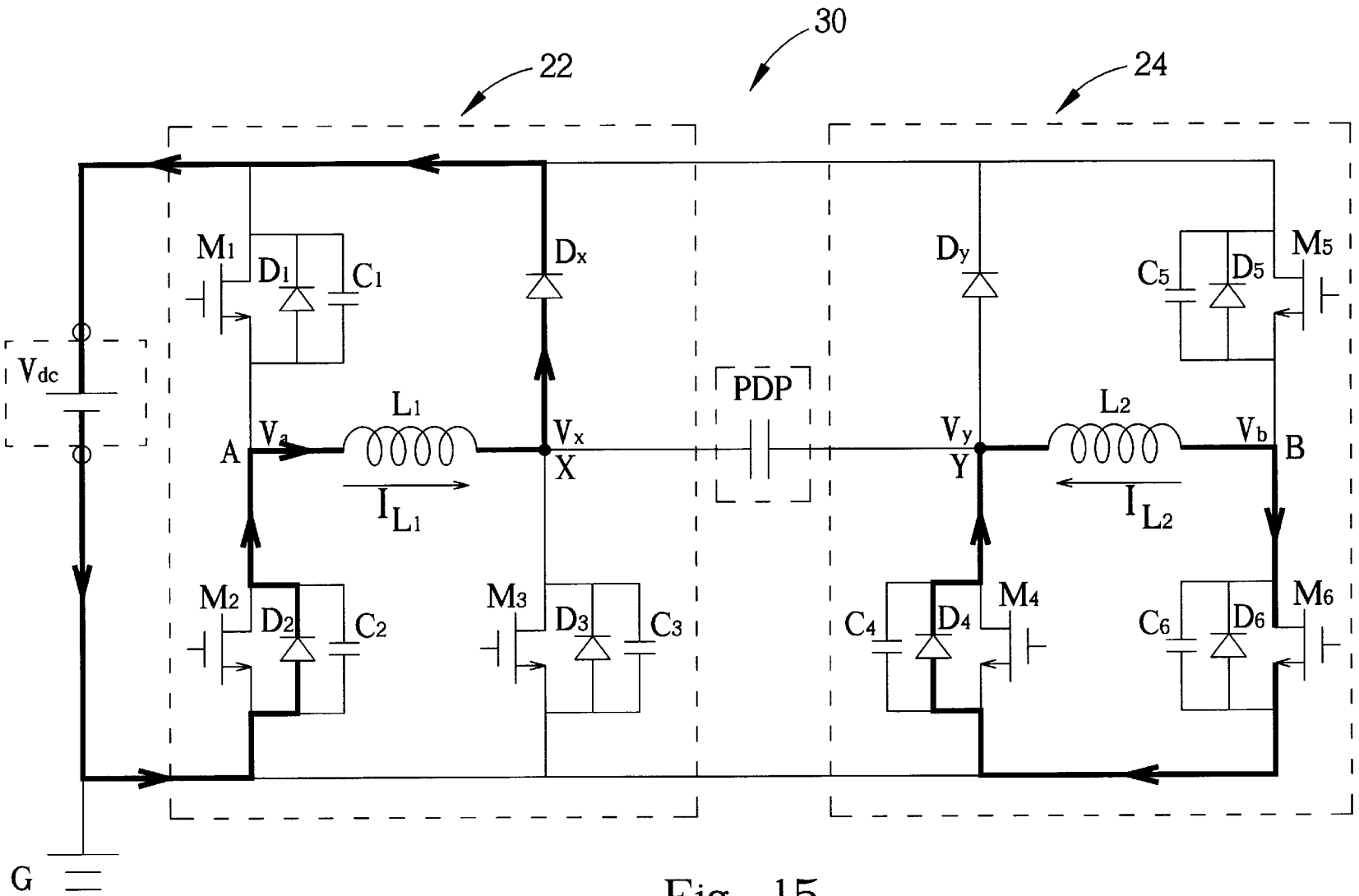

(9) As shown in FIG. 15 for the ninth stage at time $t_7$, the voltage Va at end A drops to 0 and the parasite diode D2 of the switch M2 begins to turn on. The current $I_{L1}$ of the inductor L1 begins to flow through both the parasite diode D2 of the switch M2 and the diode Dx back to the voltage source 32. At this moment, the energy stored in the inductor L1 is sent back to the voltage source 32, achieving the energy feedback function required by the plasma display driving circuit in a sustain period. In the Y sustain electrode driving unit 24, the current $I_{L2}$ through the inductor L2 is the same as the first stage.

Figure 16:
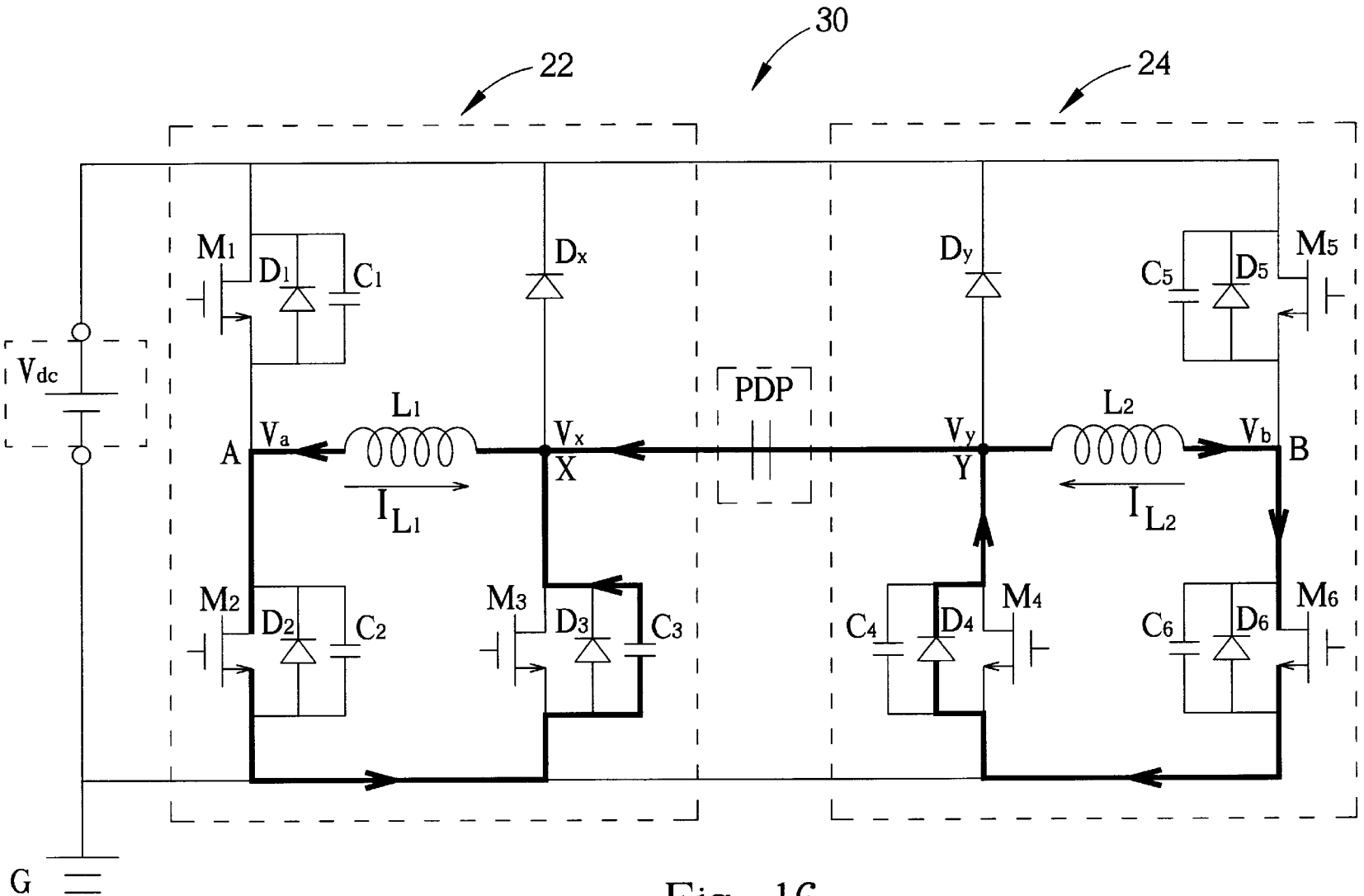

(10) As shown in FIG. 16 for the tenth stage, at time $t_8$, the current $I_{L1}$ of the inductor L1 drops to 0 and the switch M2 begins to turn on. At this moment, the plasma display panel 12 and the parasite capacitor C3 of the switch M3 begin to resonate with the inductor L1 to transmit the energy originally stored in both the plasma display panel 12 and the parasite capacitor C3 of the switch M3 back to the inductor L1. Accordingly, the voltage Vx at end X begins to drop and the current $I_{L1}$ of the inductor L1 begins to rise (the direction is from ends X to A of the inductor L1). In the Y sustain electrode driving unit 24, the current $I_{L2}$ through the inductor L2 is the same as the first stage.

Figure 17:
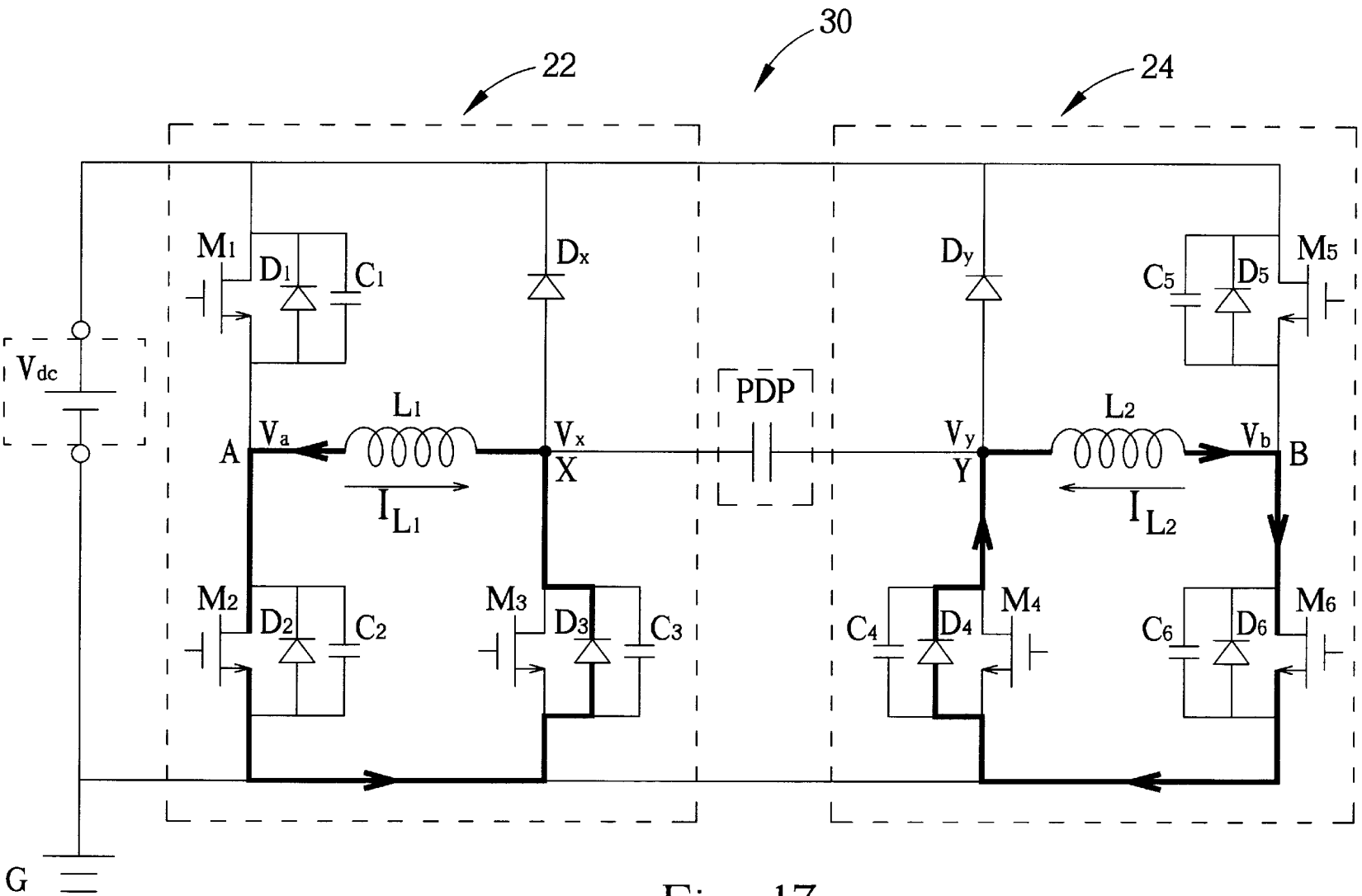

(11) As shown in FIG. 17 for the eleventh stage at time $t_9$, the voltage Vx at end X drops to 0 and the parasite diode D3 of the switch M3 begins to turn on. The current $I_{L1}$ of the inductor L1 flows through both the switch M2 and the parasite diode D3 of the switch M3 to form a constant current loop. In the Y sustain electrode driving unit 24, the current $I_{L2}$ of the inductor L2 is the same as the first stage.

Due to the symmetry of the single-sided driving units 22 and 24, the two single-sided driving circuit work in the same way at the first and eleventh stages. Therefore, for the subsequent stages, the single-sided driving units 22 and 24 work in the way the same as the other driving unit works at the second through tenth stages so as to make the switches M4 and M5 turn on for a proper time interval to store a compensation current in the inductor L2 in advance. As a result, when the voltage Vy at end Y increases to Vdc to cause the plasma display panel 12 to generate a discharge current, the plasma display panel 12 will not have large voltage notches due to ionized gas discharges since the inductor current $I_{L2}$ can sufficiently provide the required current. The plasma display panel 12 can maintain the normal display of the image signals through continuous charging back and forth. The detailed control stages are similar to those of stages two through ten and are not repeated hereinafter.

Figure 18:
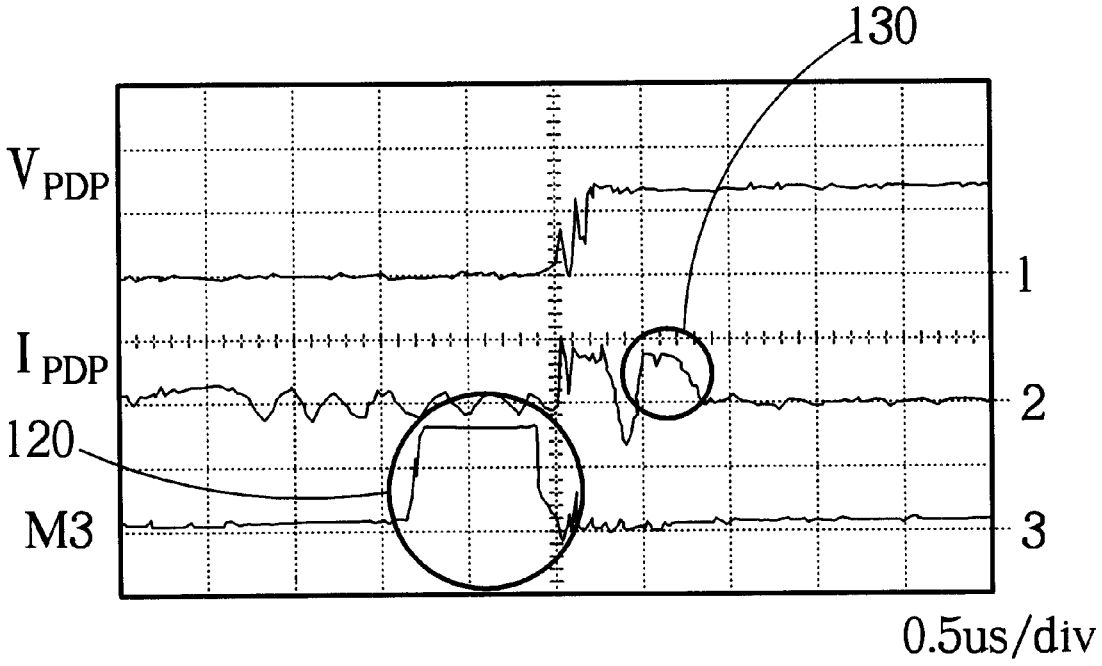
FIG. 18 illustrates the voltage and current waveforms of the plasma display when the method of the present invention is applied.

If the lowest voltage used to turn on all the pixels on the plasma display panel is 125V, then the input voltage operating range for a prior art driving circuit has to be greater than 141V because of a 16V voltage notch. Please refer to FIG. 18. FIG. 18 is the voltage waveform of the plasma display panel applying the driving method of the present invention. The time interval 120 when the switch M3 turns on is 700 ns. From the practically experimental wave diagram, when the plasma display panel gas discharge current 130 is generated, voltage $V_{PDP}$ of the plasma display panel does not have any voltage notch. Thus, the current compensation method of the present invention can effectively eliminate voltage notches due to gas discharge. Therefore, for the same plasma display panel operated under the same conditions, the range of operating voltage only has to be greater than 125V when using the disclosed discharge current compensation circuit and driving method to drive the plasma display panel. As well, the voltage source can also be 125V. The range of operating voltage of the present invention is 16V greater than the prior art driving circuit, so that the disclosed discharge current compensation circuit to compensate the voltage notches in the plasma displays can effectively increase the range of the operating voltage of the plasma displays.

Figure 19:
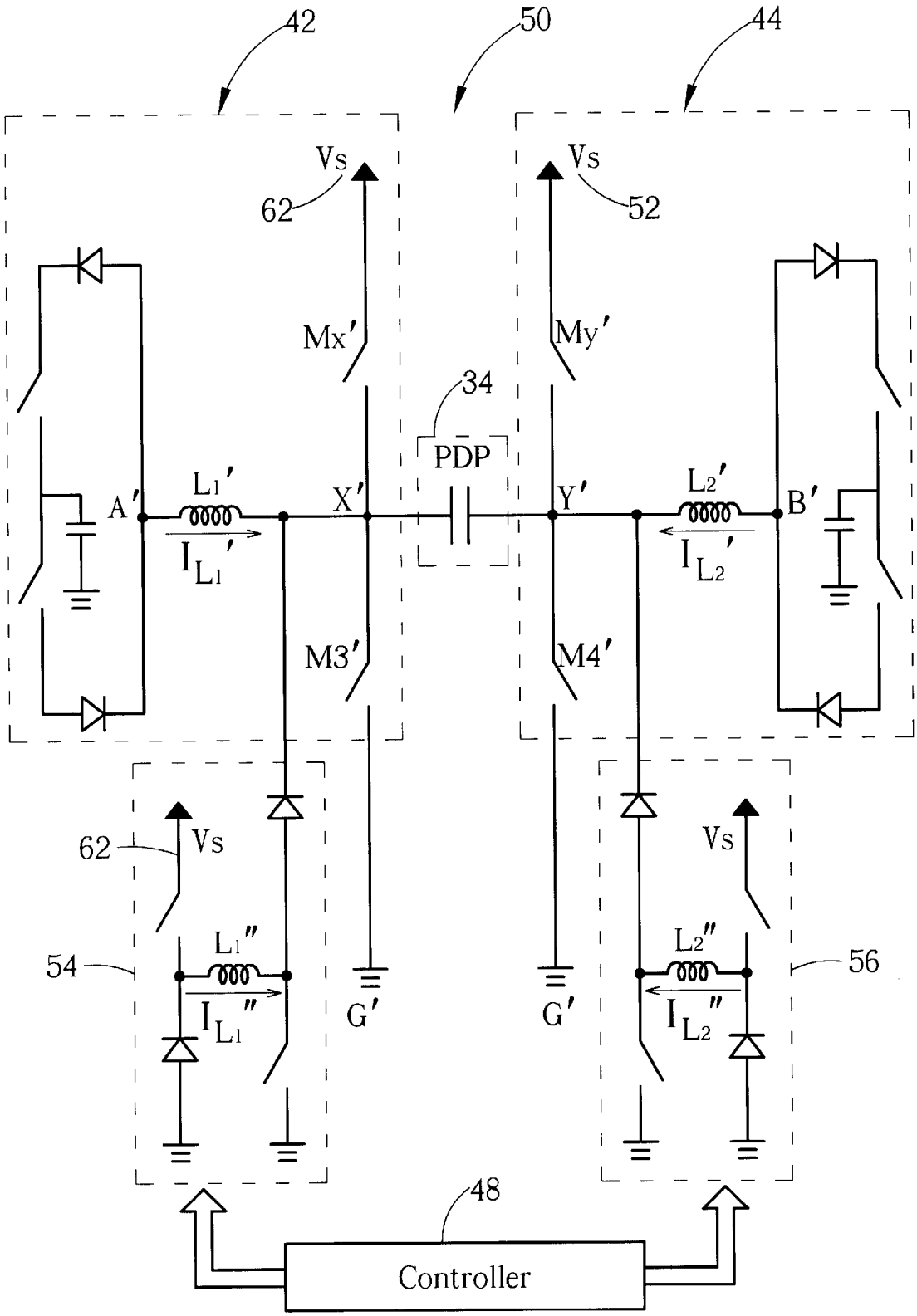
FIG. 19 shows the double-sided driving unit of the plasma display unit according to a second embodiment of the present invention.

Please refer to FIG. 19. FIG. 19 is the second embodiment of the double-sided driving unit in the plasma display panel 34 of the present invention. The plasma display panel (PDP) 34 can be viewed as a capacitor-like load. The X and Y sustain electrode driving units 42, 44 are connected to both ends of the capacitor-like load so as to maintain the display of an image signal by charging the both ends of the capacitor-like load back and forth. Therefore, the X and Y sustain electrode driving units 42, 44 are symmetrical. Each can be a single-sided driving unit, and both driving units form a double-sided driving unit 50. Furthermore, the double-sided driving unit 50 also includes a voltage source 62, 52 to provide a operating voltage Vs to the single-sided driving units 42, 44; and a controller 48 to control the single-sided driving units 42 and 44 so that the voltage source 62, 52 can charge the plasma display panel 34 back and forth through the single-sided driving units 42, 44.

The driving circuit according to the second embodiment contains: (a) a rating source 52, 62 (Vs) receiver to receive and provide a rating current; (b) a first driving unit 42 electrically connected to both the rating source receiver and the X electrode of the plasma display unit, wherein the first driving unit 42 can generate a electric potential difference between the X and Y electrodes of the plasma display unit so that the ionized gas discharges between the X and Y electrodes of the display unit; (c) a first current source generator 54 electrically connected to the X electrode of the plasma display unit to provide a first compensation current $I_{L1''}$; and (d) a controller 48 electrically connected to both the first driving unit 42 and the first current source generator 54, capable of selectively connecting the first driving unit 42 and the first current source generator 54 in parallel so as to selectively supply the rating current and the first compensation current $I_{L1}$ to the plasma display unit. Therefore, the electric potential difference between the X and Y electrodes does not drop.

The driving method according to the second embodiment includes: (a) using the receiving terminal 62 of the rating source Vs to charge the first current source generator 54 so as to generate a compensation current $I_{L1''}$; (b) using the rating source receiving terminal 62 to generate an electric potential difference between the X and Y electrodes of the plasma display unit so that the ionized gas of the plasma display unit begins to discharge between the X and Y electrodes; and (c) when the ionized gas in the plasma display unit discharges, connecting the rating source receiver 62 and the first current source generator 54 in parallel to simultaneously provide the rating current and the compensation current $I_{L1''}$ to the plasma display unit so that the electric potential difference between the X and Y electrodes does not drop. The basic structure of the single-sided driving units 42, 44 of the present invention is similar to the one used in the prior art plasma display driving circuit. Under this basic structure, a first current source generator 54 and a second current source generator 56 are added to the single-sided driving units 42, 44, respectively, to compensate the larger current required for the instantaneous discharge of the plasma display panel 34. The circuit operations of the prior art plasma display driving circuit will not be described herein. The first current source generator 54 contains an inductor L1" and the second current source generator 56 contains an inductor L2". When the two switches in the first current source generator 54 are all turned on, the voltage source Vs charges the inductor L1" to generate the required compensation current. When the switch connected to the ground in the first current source generator 54 is turned off, then the current of the inductor L1" flows into the plasma display panel 34 to compensate the gas discharge current therein. When the two switches in the first current source generator 54 are both turned off, then the current of the inductor L1" flows back to the voltage source Vs to return the unnecessary energy back to the power source. When the two switches in the second current source generator 56 are turned on, the voltage source Vs charges the inductor L2" to generate the required compensation current. When the switch connected to the ground in the second current source generator 56 is turned off, then the current of the inductor L2" flows into the plasma display panel 34 to compensate the gas discharge current therein. When the two switches in the second current source generator 56 are both turned off, the current of the inductor L2" flows back to the voltage source Vs to send the unnecessary energy back to the power source.

Compared with the prior art, the double-sided driving unit 30 introduced in the first embodiment of the present invention turns on the switches M3 and M4 to store a compensation current in the inductors L1 and L2 before the plasma display panel 12 discharges. When the plasma display panel 12 discharges, the inductor currents $I_{L1}$ and $I_{L2}$ are already compensated and thus can provide sufficient current required for discharges. As a result, voltage notches of the driving waveforms are reduced. Therefore, the present invention can increase the operating voltage range of the plasma display 10, and further ensure the display quality even after prolonged usage.

The double-sided driving unit 50 according to the second embodiment involves adding a first current source generator 54 and a second current source generator 56 to the existing circuit structure. Under the control of the controller 48, the plasma display panel 34 can obtain a compensation current and achieve the goal of reducing the voltage notches of the driving waveforms, and ensure display quality even after prolonged usage.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driving method for driving a plasma display unit of a plasma display panel using a driving circuit, the plasma display unit comprising two electrodes with an ionized gas between the two electrodes, the driving circuit driving the ionized gas back and forth between the two electrodes to cause the plasma display panel to emit light, the driving circuit comprising a rating source receiver and an energy storing current source, the rating source receiver being capable of receiving and supplying a rating current, the driving method comprising:

charging the energy storing current source with the rating source receiver to cause the energy storing current source to generate a compensation current, the compensation current being larger than the rating current;

using the energy storing current source to generate a first electric potential difference between the two electrodes of the plasma display unit so that the ionized gas in the plasma display unit starts to discharge; and while the ionized gas of the plasma display unit is discharging, supplying the plasma display unit with the compensation current generated by the energy storing current source so as to prevent an electric potential difference drop caused by the rating current being insufficient to supply the discharging of the ionized gas.

2. The driving method of claim 1 wherein after the discharging of the ionized gas of the plasma display unit, the driving circuit is used to generate a second electric potential difference opposite to the first electric potential difference between the two electrodes of the plasma display unit so that the ionized gas of the plasma display unit starts to discharge in an opposite direction between the two electrodes.

3. A driving method for driving a plasma display unit of a plasma display panel using a driving circuit, the plasma display unit comprising two electrodes with an ionized gas between the two electrodes, the driving circuit driving the ionized gas back and forth to cause the plasma N display unit to emit light, the driving circuit comprising a rating source receiver and a first current source generator, the rating source receiver being capable of receiving and supplying a rating current, the driving method comprising:

charging the first current source generator with the rating source receiver to cause the first current source generator to generate a compensation current, the compensation current being larger than the rating current;

using the rating current source to generate a first electric potential difference between the two electrodes of the plasma display unit so that the ionized gas in the plasma display unit starts to discharge; and while the ionized gas of the plasma display unit is discharging, using the rating source receiver and the first current source generator in parallel to supply the plasma display unit with both the compensation current and the rating current so as to prevent an electric potential difference drop caused by the rating current being insufficient to supply the discharging of the ionized gas.

4. The driving method of claim 3 wherein after the discharging of the ionized gas of the plasma display unit, the driving circuit is used to generate a second electric potential difference opposite to the first electric potential difference between the two electrodes of the plasma display unit so that the ionized gas of the plasma display unit starts to discharge in an opposite direction between the two electrodes.

5. A driving method for driving a plasma display unit of a plasma display panel using a driving circuit, the plasma display unit comprising two electrodes with ionized gas between the two electrodes, the driving circuit driving the ionized gas back and forth between the two electrodes to cause the plasma display panel to emit light, the driving circuit comprising a rating source receiver and an independent source receiver, the rating source receiver being capable of receiving and supplying a rating current, the independent current source receiver being capable of receiving and supplying a compensation current, the driving method comprising:

using the rating current receiver to build a first electric potential difference between the two electrodes of the plasma display unit so that the ionized gas in the plasma display unit starts to discharge; and while the ionized gas of the plasma display unit is discharging, using the rating source receiver and the independent current source receiver in parallel to supply the plasma display unit with both the rating current and the compensation current so as to prevent an electric potential difference drop caused by the rating current being insufficient to supply the discharging of the ionized gas.

6. The driving method of claim 5 wherein after the discharging of the ionized gas of the plasma display unit, the driving circuit is used to generate a second electric potential difference opposite to the first electric potential difference between the two electrodes of the plasma display unit so that the ionized gas of the plasma display unit starts to discharge in an opposite direction between the two electrodes.

7. A driving circuit for driving a plasma display unit of a plasma display panel, the plasma display unit comprising two electrodes with ionized gas between the two electrodes, the driving circuit driving the ionized gas back and forth between the two electrodes to cause the plasma display unit to emit light, the driving circuit comprising:

a rating source receiver for receiving and supplying a rating current;

a first driving unit electrically connected to the rating current receiver and a first electrode of the two electrodes of the plasma display unit, the first driving unit being capable of building a first electric potential difference between the two electrodes of the plasma display unit to cause the ionized gas of the plasma display unit to discharge between the two electrodes;

a first current source generator electrically connected to the first electrode of the plasma display unit, the first current source generator capable of supplying a first compensation current; and a controller electrically connected to the first driving unit and the first current source generator, the controller capable of selectively placing the first driving unit and the first current source generator in parallel to selectively supply the plasma display unit with both the rating current and the first compensation current so as to prevent an electric potential difference drop caused by the rating current being insufficient to supply discharging of the ionized gas.

8. The driving circuit of claim 7 wherein the first current source generator comprises an inductor, and before the plasma display unit discharges, the controller causes the first current source generator to charge the inductor and store a current in the inductor, and when the ionized gas of the plasma display unit discharges, the controller causes the current stored in the inductor to flow into the plasma display unit as the first compensation current.

9. The driving circuit of claim 7 further comprising a second driving unit and a second current source generator electrically connected to a second electrode of the two electrodes of the plasma display unit, the second current source generator being controlled by the controller; wherein after the plasma display unit discharges, the controller builds a second electric potential difference opposite to the first electric potential difference using the first driving unit and the second driving unit, and in an opposite direction between the two electrodes, and before the ionized gas discharges in the opposite direction, the controller supplies a second compensation current using the second current source generator through the second electrode of the plasma display unit so that an electric potential difference between the two electrodes will not suffer a substantial drop greatly caused by the discharging of the ionized gas.

10. A driving circuit for driving a plasma display unit of a plasma display panel, the plasma display unit comprising two electrodes with ionized gas between the two electrodes, the driving circuit driving the ionized gas back and forth between the two electrodes to cause the plasma display unit to emit light, the driving circuit comprising:

a rating source receiver capable of receiving and supplying a rating current;

a first driving unit electrically connected to the rating current receiver and a first electrode of the two electrodes of the plasma display unit, the first driving unit comprising an energy storing current source, the energy storing current source capable of supplying a compensation current and generating a first electric potential difference between the two electrodes of the plasma display unit to cause the ionized gas of the plasma display unit to discharge between the two electrodes; and a controller electrically connected to the first driving unit and the rating current receiver, the controller being capable of selectively causing the rating current receiver to charge the energy storing current source to generate the compensation current;

wherein when the ionized gas of the plasma display unit discharges, the compensation current is used to keep the electric potential difference between the two electrodes stable.

11. The driving circuit of claim 10 wherein the current source of the first driving unit comprises an inductor, and when the first driving unit generates the first electric potential difference between the two electrodes of the plasma display unit, the first driving unit will charge the inductor and store a current in the inductor, and when the ionized gas of the plasma display unit discharges, the current stored in the inductor will flow into the plasma display unit as the compensation current.

12. A driving circuit for driving a plasma display unit of a plasma display panel, the plasma display unit comprising two electrodes with ionized gas between the two electrodes, the driving circuit driving the ionized gas between the two electrodes back and forth to cause the plasma display unit to emit light, the driving circuit comprising:

two driving units respectively electrically connected to the two electrodes of the plasma display unit to drive the ionized gas back and forth between the two electrodes so that the plasma display unit emits light;

a first current source generator electrically connected to a first electrode of the plasma display unit; and a controller electrically connected to the two driving units and the first current source generator to control the operation of the two driving units and the first current source generator;

wherein before the plasma display unit discharges, the controller builds a first electric potential difference between the two electrodes of the plasma display unit using the two driving units so that the ionized gas of the plasma display unit starts to discharge between the two electrodes, and when the ionized gas of the plasma display unit discharges, the controller provides a compensation current to the first electrode of the plasma display unit using the first current source so as to prevent an electric potential difference drop caused by the discharging of the ionized gas.

13. The driving circuit of claim 12 wherein the first current source generator comprises an inductor, and when the two driving units build the first electric potential difference between the two electrodes of the plasma display unit, the controller charges the inductor with the first current source generator and stores a current in the inductor, and when the ionized gas of the plasma display unit discharges, the controller will cause the current stored in the inductor to flow into the plasma display unit to compensate for the discharging of the ionized gas.

14. The driving circuit of claim 12 further comprising a second current source generator controlled by the controller, the second current source generator being electrically connected to a second electrode of the plasma display unit; wherein after the plasma display unit discharges, the controller builds a second electric potential difference opposite to the first electric potential difference with the two driving units so that the ionized gas of the plasma display unit starts to discharge in an opposite direction between the two electrodes, and when the ionized gas of the plasma display unit discharges, the controller will causes the second current source generator to provide a compensation current to the plasma display unit through the second electrode of the plasma display unit so as to prevent a substantial drop of electric potential difference between the two electrodes due to the discharging of the ionized gas.

15. The driving circuit of claim 14 wherein the second current source generator comprises an inductor, and when the two driving units build the second electric potential difference between the two electrodes of the plasma display unit, the controller charges the inductor with the second current source generator and stores a current in the inductor, and when the ionized gas of the plasma display unit discharges, the controller causes the current stored in the inductor to flow into the plasma display unit to compensate for the discharging of the ionized gas.

16. A driving circuit for driving a plasma display unit of a plasma display panel, the plasma display unit comprising two electrodes with ionized gas between the two electrodes, the driving circuit driving the ionized gas between the two electrodes back and forth to cause the plasma display unit to emit light, the driving circuit comprising:

two driving units respectively electrically connected to the two electrodes of the plasma display unit to drive the ionized gas back and forth between the two electrodes so that the plasma display unit emits light, each of the two driving units comprising a current source electrically connected to an electrode of the plasma display unit; and a controller electrically connected to the two driving units and the two current sources to control the operation of the two driving units and the two current sources;

wherein before the plasma display unit discharges, the controller builds a first electric potential difference between the two electrodes of the plasma display unit using the two driving units so that the ionized gas of the plasma display unit starts to discharge between the two electrodes, and when the ionized gas of the plasma display unit discharges, the controller provides a compensation current to a first electrode of the plasma display unit using the current source of one of the two driving units so as to prevent an electric potential difference drop caused by the discharging of the ionized gas.

17. The driving circuit of claim 16 wherein each of the current sources of the two driving units comprises an inductor, and when the two driving units build the first electric potential difference, one of the two driving units will charge the inductor of the driving unit and store a current in the inductor, and when the ionized gas of the plasma display unit discharges, the current stored in the inductor will flow into the plasma display unit to provide the compensation current while the ionized gas discharges.

* * * * *